US012064703B2

(12) United States Patent
Murakami et al.

(10) Patent No.: US 12,064,703 B2
(45) Date of Patent: Aug. 20, 2024

(54) TOY TRACK

(71) Applicant: SEGA TOYS CO., LTD., Tokyo (JP)

(72) Inventors: Seiji Murakami, Tokyo (JP); Yoichiro Seto, Tokyo (JP)

(73) Assignee: SEGA TOYS CO., LTD., Tokyo (JP)

( * ) Notice: Subject to any disclaimer, the term of this patent is extended or adjusted under 35 U.S.C. 154(b) by 832 days.

(21) Appl. No.: 17/187,529

(22) Filed: Feb. 26, 2021

(65) Prior Publication Data

US 2021/0370191 A1 Dec. 2, 2021

(30) Foreign Application Priority Data

Jan. 7, 2020 (JP) ..... 2020-000714

(51) Int. Cl.

*A63H 18/02* (2006.01)
*A63H 18/06* (2006.01)
*A63H 17/00* (2006.01)

(52) U.S. Cl.

CPC ..... *A63H 18/02* (2013.01); *A63H 18/028* (2013.01); *A63H 18/06* (2013.01); *A63H 17/00* (2013.01)

(58) Field of Classification Search

CPC ..... A63H 17/008; A63H 17/42; A63H 18/00; A63H 18/02; A63H 18/023; A63H 18/025; A63H 18/026; A63H 18/04; A63H 18/06

See application file for complete search history.

(56) References Cited

U.S. PATENT DOCUMENTS 5,643,040 A * 7/1997 Hippely ..... A63H 18/00 446/423

FOREIGN PATENT DOCUMENTS

| | | | | |
|---|---|---|---|---|
| CA | 2525024 A1 * | 12/2006 | ..... | A63H 18/025 |
| DE | 1905263 A1 * | 8/1970 | ..... | A63H 18/06 |
| JP | 2004229813 A * | 8/2004 | ..... | A63H 18/02 |
| JP | 2018-057496 A | 4/2018 | | |
| KR | 101438196 B1 * | 10/2014 | ..... | A63H 29/24 |

* cited by examiner

*Primary Examiner* — Zachary L Kuhfuss
*Assistant Examiner* — Heaven R Buffington
(74) *Attorney, Agent, or Firm* — The Marbury Law Group PLLC

(57) ABSTRACT

A toy track of the invention includes a base member, a track member having a track surface portion where a toy vehicle can travel and biased into a deployed state where the track surface portion slopes down to a front relative to the base member, a lid member connected to the base member to be opened and closed and having a locked portion, and a locking member having a releasing projection disposed on the track surface portion of the track member in a stowed state and a locking portion for locking the locked portion to hold the lid member in a closed state. The lid member biases the track member into the stowed state when in the closed state, and the locking member releases locking of the locking portion on the locked portion when the releasing projection is pressed by the toy vehicle entering the track surface portion.

18 Claims, 10 Drawing Sheets

TOY TRACK

CROSS-REFERENCE TO RELATED APPLICATION

This patent application is based upon and claims the benefit of priority under 35 USC 119 of Japanese Patent Application No. 2020-000714 filed on Jan. 7, 2020. The right of priority has been restored under Rule 1.55. The entire disclosure of the patent application, including the specification, claims, drawings and abstract, is incorporated herein by reference.

BACKGROUND OF THE INVENTION

Field of the Invention

The present invention relates to a toy track on which a toy vehicle can run.

Description of the Related Art

There have conventionally been proposed toy tracks on which a toy four-wheeled vehicle can run. For example, Japanese Patent Laid-Open No. 2018-57496 (JP-A-2018-57496) discloses a track for a running toy (a toy track), which includes track portions, which constitute a running track surface for a self-propelled toy, and guide walls provided at both sides of the track portions. Thus, this toy track constitutes the running track for the self-propelled toy.

The toy track disclosed in JP-A-2018-57496 described above is such that the self-propelled toy is caused to run along the track portions which are fixedly assembled together in advance, and hence, a player can easily anticipate movements of the self-propelled toy while the toy is running due to lack of change. Thus, it is anticipated that the player gets tired of playing with the toy track.

SUMMARY OF THE INVENTION

The present invention has been made in view of the situations described above, and an object of the present invention is to provide a toy track that is full of changes.

According to an aspect of the present invention, there is provided a toy track including a base member, a track member having a track surface portion on which a running body can travel and biased so as to be put in a deployed state in which the track surface portion slopes down to a front relative to the base member, a lid member connected to the base member in such a manner as to be opened and closed and having a first locked portion, and a locking member having a releasing projection disposed on the track surface portion of the track member in a stowed state and a first locking portion configured to be locked on the first locked portion to hold the lid member in a closed state, wherein the lid member biases the track member into the stowed state when in the closed state, and wherein the locking member releases locking of the first locking portion on the first locked portion when the releasing projection is pressed against by the running body that enters the track surface portion.

According to the aspect of the present invention, the toy track can be provided which is full of changes.

DETAILED DESCRIPTION OF THE PREFERRED EMBODIMENT

Figure 1:
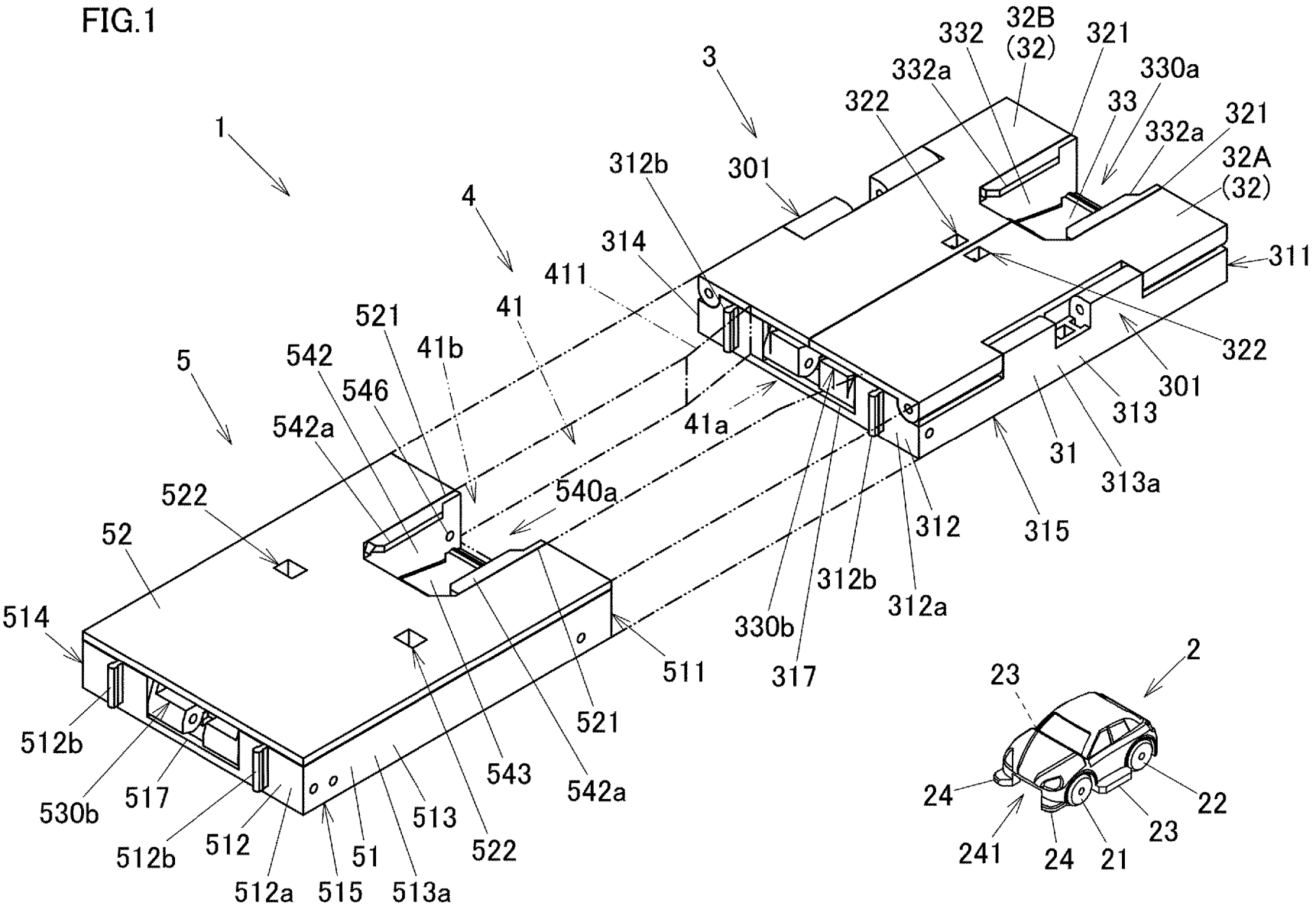
FIG. 1 is an overall perspective view of a toy track set including toy tracks, which are in a stowed state, according to an embodiment of the present invention.

Hereinafter, an embodiment of the present invention will be described using accompanying drawings. A toy track set 1 shown in FIG. 1 includes toy tracks 3 to 5 having different forms and coupled to one another. A toy vehicle 2 can run on the toy tracks 3 to 5. The toy vehicle 2 is copied from a four-wheeled motor vehicle and has front wheels 21 and rear wheels 22 that can rotate freely on axle shafts that are loosely fitted in a vehicle body. A side rib 23 is formed on each of left- and right-hand sides of the vehicle body of the toy vehicle 2 in such a manner as to extend in a front-rear direction so as to be formed into a long and flat plate-like shape. In addition, a front rib 24 is formed on each of left- and right-hand sides of a front end of the toy vehicle 2 in such a manner as to project forwards. A recessed portion 241 is defined between left and right front ribs 24.

Figure 8:
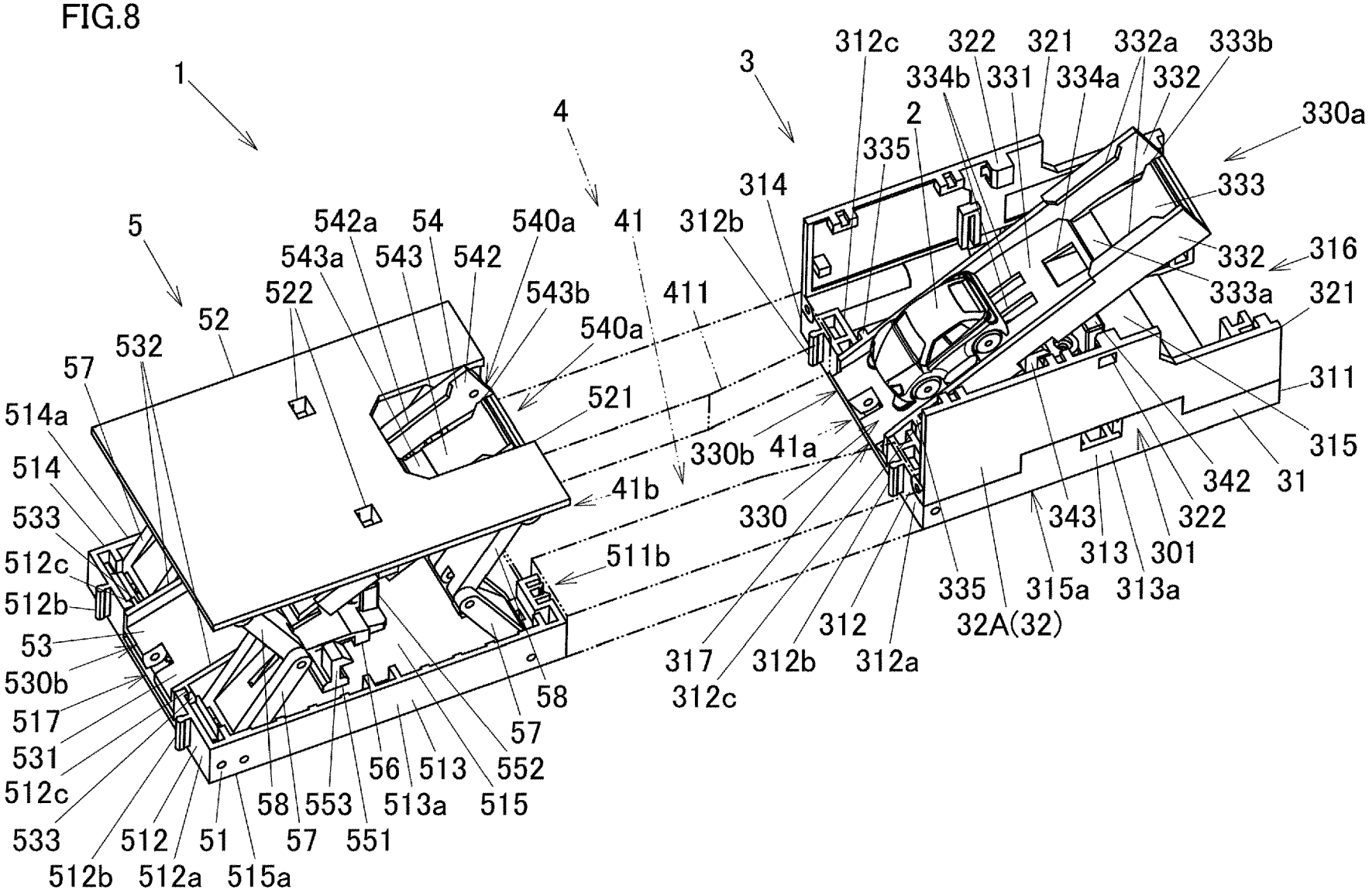
FIG. 8 is an overall perspective view of the toy track set including the toy tracks, which are in the deployed state, according to the embodiment of the present invention.

The toy tracks 3 to 5 can be coupled together so as to be aligned end to end in an arbitrary order. The toy tracks 3 to 5, which are coupled together, have substantially the same vertical thickness and transverse width. Additionally, the toy tracks 3 to 5 can have substantially the same longitudinal length. The toy track 3 constitutes a front-stage toy track, while the toy track 5 constitutes a rear-stage toy track, and the front-stage and rear-stage toy tracks 3, 5 are configured so that when the toy vehicle 2 enters them from an entrance side, the front-stage and rear-stage toy tracks 3, 5 are transformed in such a manner as to be deployed upwards (refer to FIG. 8) so that the toy vehicle 2 can move into the next-stage toy track coupled ahead. Hereinafter, in describing the toy tracks 3 to 5, the entrance side of the toy tracks 3 to 5 is referred to as rear, and an exit side thereof is referred to as front. A left-hand side of the toy tracks 3 to 5 when seen from the rear is referred to as left, and an opposite side thereto is referred to as right. In addition, an up of the toy tracks 3 to 5 shown in FIG. 1 is referred to as up, and an opposite thereto is referred to as down.

The configuration of the toy track 3 will be described by reference mainly to FIGS. 1, 2A, and 3. As shown in FIG. 1, the toy track 3 includes a base member 31, which is disposed downwards and which has a substantially rectangular flat plate-like shape, and a lid member 32, which is connected to the base member 31 rotatably around a hinge portion 301, whereby the toy track 3 is formed into a substantially rectangular flat plate-like shape as a whole when the lid member 32 rests in a closed state. Additionally, as shown in FIG. 3, the toy track 3 includes a track member 33, which is long in the front-rear direction in an interior of the toy track 3, and a locking member 34 configured to support or hold the lid member 32 in the closed state. With the lid member 32 staying in the closed state, the track member 32 is folded up in a stowed state between the base member 31 and the lid member 32.

The base member 31 has a rear wall 311, a front wall 312, a left wall 313, and a right wall 314 which are formed around an outer circumference of a bottom plate 315, which has a rectangular plate-like shape. The rear wall 311 and the front wall 312 are formed in such a manner as to extend transversely at a rear end and a front end of the bottom plate 315, respectively. The left wall 313 and the right wall 314 are formed in such a manner as to extend in the front-rear direction along a left longitudinal edge and a right longitudinal edge of the bottom plate 315, respectively. In addition, the base member 31 has a rear end face 311*a*, a front end face 312*a*, a left side surface 313*a*, a right side surface 314*a*, and a bottom surface 315*a*, which each have a flat outer surface.

A shaft portion 301*a*, which makes up the hinge portion 301, is formed at an upper end portion of each of the left wall 313 and the right wall 314. An entrance opening portion 316, which is continuously cut out into a rectangular shape, is formed in a transversely central portion of the rear wall 311 and a transversely central portion of a rear end of the bottom plate 315. The entrance opening portion 316 is formed in a side of the track member 33 where an entrance 330*a* is provided. In addition, an exit opening portion 317 is formed in a transversely central portion of the front wall 312. The exit opening portion 317 is cut out into a rectangular shape having substantially the same width as that of the entrance opening portion 316. The exit opening portion 317 is formed in a side of the track member 33 where an exit 330*b* is provided.

Figure 2A:
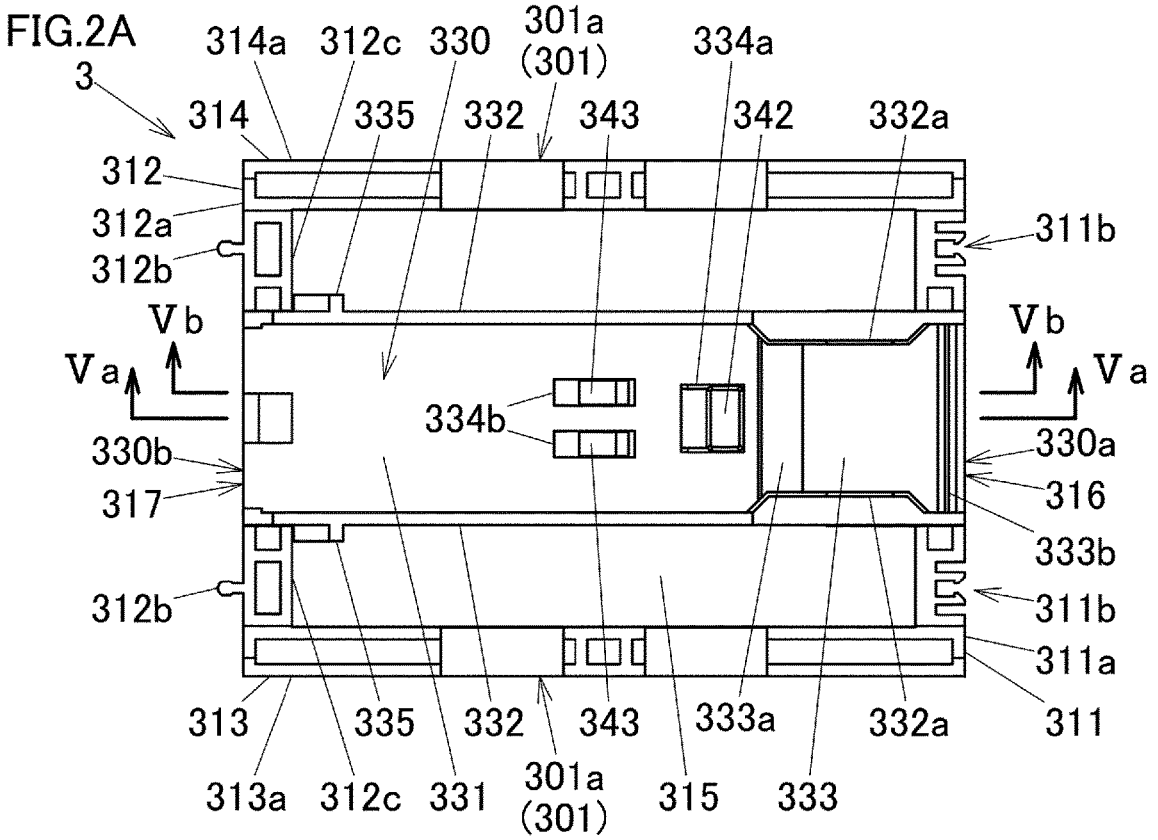
FIG. 2A is a plan view of a transformable toy track according to the embodiment of the present invention with a lid member omitted from illustration, which constitutes a front-stage toy track shown in FIG. 1.
Figure 3:
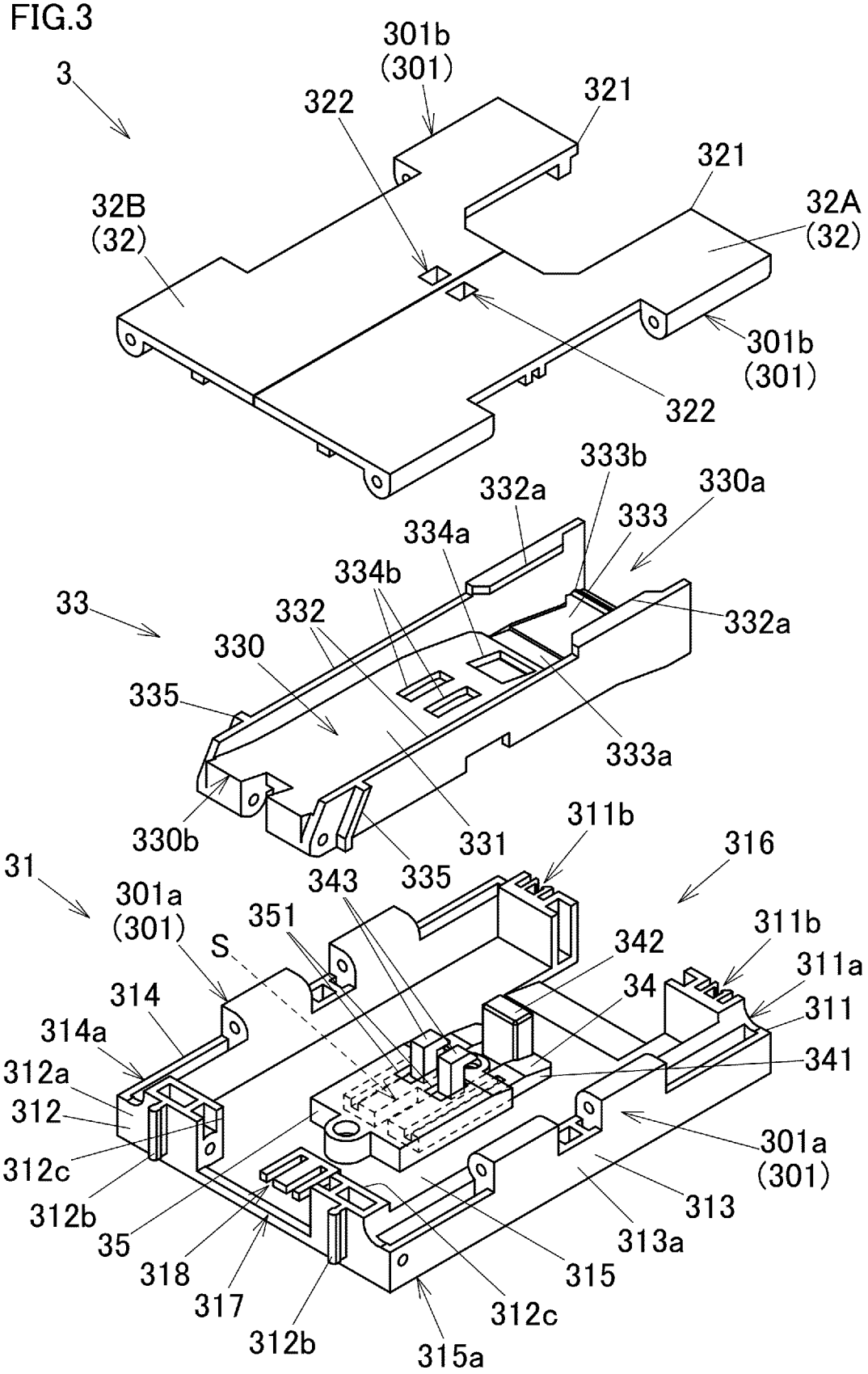
FIG. 3 is an exploded perspective view of the toy track, which is shown in FIG. 2A, according to the embodiment of the present invention.

As shown in FIGS. 2A and 3, a locked portion 311*b* (a second locked portion) is formed on the rear end face 311*a* of the rear wall 311 at each of sides of the entrance opening portion 316 which face the left wall 313 and the right wall 314. The locked portion 311*b* is made up of two holding pieces which are formed so as to be resiliently bifurcated. A locking portion 312*b* (a second locking portion) is formed on the front end face 312*a* of the front wall 312 at each of sides of the exit opening portion 317 which face the left wall 313 and the right wall 314 so as to be locked on each of locked portions of the other toy tracks 3 to 5 (the locked portion 311*b* in the case of the toy track 3). The locking portion 312*b* is formed into a rib-like shape by a flat plate piece provided in such a manner as to extend in an up-down direction. The locking portion 312*b* has a protruding portion which is formed at a distal end side thereof by increasing its thickness greater at the distal end side than a proximal end side. This protruding portion is locked by narrow projections provided on facing surfaces at distal ends of the flat plate pieces of the locked portion 311*b*. Each locking portion 312*b* can detachably be attached to the corresponding locked portion 311*b* with a predetermined force or greater (this will also be true with a locking portion 512*b* and a locked portion 511*b*, which will be described later).

In FIG. 3, the locking member 34 and a guide member 35 for guiding the locking member 34 in sliding are disposed substantially at a center of the bottom plate 315. A receiving portion 318 is formed on the bottom plate 315 at a front side of the guide member 35, and this receiving portion 318 supports a biasing member (not shown) such as a torsion coil spring for biasing the track member 33 in a rising direction.

The locking member 34 is formed movably in the front-rear direction inside the guide member 35. The locking member 34 has a flat plate-shaped base portion 341 disposed substantially parallel to the bottom plate 315, a quadrangular prism-shaped releasing projection 342 provided in such a manner as to rise upwards from a rear end of the base portion 341 which faces the entrance opening portion 316, and a plurality of locking portions 343 (a first locking portion) provided in such a manner as to rise upwards from a position of the base portion 341 which lies nearer to the exit opening portion 317 than the releasing projection 342 does. A claw portion extending to the rear is formed on a rear side (a side facing the releasing projection 342) of a distal end portion of each of the locking portions 343.

Figure 5A:
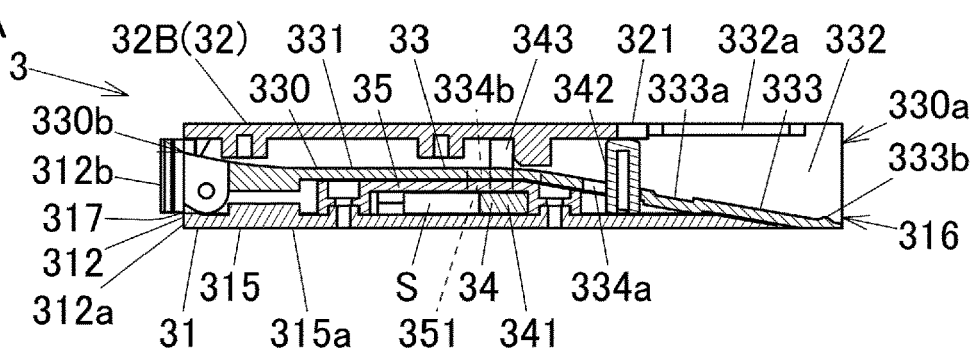
FIGS. 5A and 5B are sectional views of the toy track, which is in the stowed state, according to the embodiment of the present invention, which are taken along lines Va-Va and Vb-Vb of the toy track shown in FIG. 2A, respectively.

The guide member 35 is formed into a substantially flat plate-like shape and has opening portions 351 formed in an upper plate so as to allow the locking portions 343 to pass therethrough. In this embodiment, two projecting portions 343 are provided in such a manner as to project upwards through the two corresponding opening portions 351. The guide member 35 restricts a movable range of the locking member 34 when the locking member 34 moves forwards and rearwards by covering partially the base portion 341 of the locking member 34 from above. Then, as shown in FIG. 5A, the locking member 34 is biased to the rear of the guide member 35 by a biasing member (not shown) such as a compression coil spring provided within a space S defined inside the guide member 35.

The track member 33 is formed into a long and flat plate-like shape and has substantially the same longitudinal length as that of the base member 31. The track member 33 has a track surface portion 331 and side walls 332 which are provided in such a manner as to extend upwards and downwards from both left- and right-hand sides of the track surface portion 331. Thus, a track portion 330 is defined by the track surface portion 331 and the side walls 332 into a recessed space extending in the front-rear direction.

A waiting portion 333 for the toy vehicle 2 is formed on the track surface portion 331 at a side thereof where an entrance 330*a* is provided. In a state in which the track member 33 is stowed, the waiting portion 333 is disposed to slope downwards as it extends rearwards in a position lying lower in level than a side of the track surface portion 331 where an exit 330*b* is provided (refer to FIG. 5A). A depressed portion 333*a* is formed ahead of the waiting portion 333 so as to restrict forward and rearward movements of the toy vehicle 2 by allowing the front wheels 21 of the toy vehicle 2 to loosely be fitted therein. In addition, a restricting projection 333*b* is formed at the rear of the waiting portion 333 so as to restrict a rearward movement of the toy vehicle 2 by holding the rear wheels 22 of the toy vehicle 2. The depressed portion 333*a* and the restricting projection 333*b* formed in such a manner as to extend transversely of the waiting portion 333 to function as a vehicle stopper. The track surface portion 331 slopes at different angles at a portion where the entrance 330*a* is provided and the waiting portion 333 is formed, a portion where the exit 330*b* is provided, and an intermediate portion between the entrance 330*a* and the exit 330*b*. With the toy track 3 staying in the stowed state (refer to FIG. 6), the sloping angles at the portion where the entrance 330*a* is provided and the portion where the exit 330*b* is provided are made smaller than a sloping angle at the intermediate portion.

A plurality of opening portions 334*a* and 334*b* are formed in the track surface portion 331 ahead of the waiting portion 333. With the track member 33 held in the stowed state, as shown in sectional views of FIGS. 5A and 5B, the releasing projection 342 of the locking member 34 is inserted and passed through the opening portion 334*a*. Consequently, a distal end portion of the releasing projection 342 is positioned above the track surface portion 331. Similarly, with the track member 33 held in the stowed state, the locking portions 343 of the locking member 34 are inserted and passed through the corresponding opening portions 334*b*. The distal end portions, which include the claw portions, of the locking portions 343 are positioned above the track surface portion 331, so that the claw portions can be locked on the two corresponding locked portions 322 (the first locked portion) of the lid member 32, which is now folded up in the closed state, to thereby hold the lid member 32 in the closed state.

Support projections 332*a* are provided on facing inner surfaces of the side walls 332 of the waiting portion 333 in such a manner as to project therefrom so as to prevent the toy vehicle 2 stopping at the waiting portion 333 from derailing. When referred to herein, the derailing means a state in which the toy vehicle 2 leaves from the inside of the track member 33 without leaving by way of the exit 330*b*. The support projections 332*a* can prevent the toy vehicle 2 from being thrown away to the front by a reaction force generated when the track member 33 is rotated in the rising direction. The support projections 332*a* are formed in a position lying above the side ribs 23 of the toy vehicle 2 parked on the waiting portion 333. In addition, a gap width between the facing support projections 332*a* is formed narrower than a transverse width of the toy vehicle 2 placed on the waiting portion 333, the transverse width including both the side ribs 23. Restricting projections 335 are formed on outer surfaces of the left and right side walls 332 at portions close to the exit 330*b*. With the track member 33 held in a deployed state, the restricting projections 335 are brought into abutment with inner surfaces 312*c* of the front wall 312 of the base member 31 to thereby restrict the rotation of the track member 33 in the rising direction.

Figure 5B:
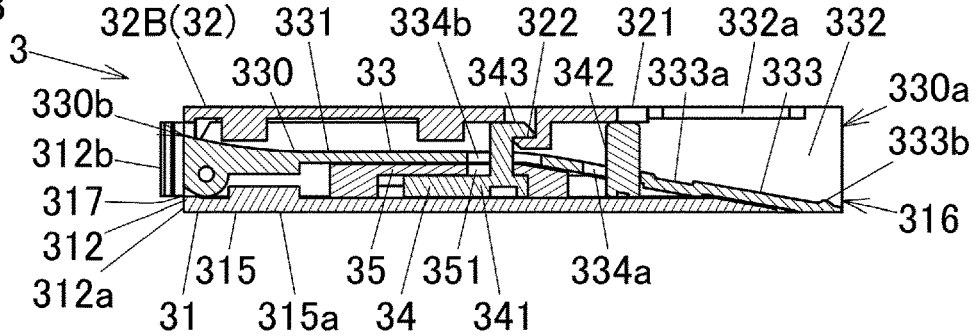

The lid member 32 is made up of a lid member 32A and a lid member 32B which are laterally symmetrical with each other. The lid member 32A and the lid member 32B each have a shaft portion 301*b*, which makes up the hinge portion 301 together with the shaft portion 301*a* of the base member 31, on a longer side thereof. Consequently, the lid member 32A and the lid member 32B can be opened away from and closed towards each other. In addition, the lid member 32A and the lid member 32B each have a cut-out portion 321 which is cut out into a rectangular shape in a closed state at a rear end portion, which faces the entrance 330*a*. The locked portions 322 (the first locked portion) are formed ahead of the cut-out portions 321 of both the lid members 32A, 32B. As shown in FIG. 5B, the locked portion 322 has a claw portion provided on a rear surface of each of the lid members 32A, 32B in such a manner as to extend to the front so as to be locked by the claw portion of the corresponding locking portion 343.

Returning to FIG. 1, the toy track 4, which is disposed one stage ahead of the toy track 3, is formed into a substantially rectangular flat plate-like shape as a whole. The toy track 4 has a track portion 41 of a recessed groove shape which extends in the front-rear direction. The track portion 41 has an extended width portion 411 which is defined by left and right inner surfaces of an entrance 41*a* of the track portion 41 in such a manner that a transverse width thereof increases as the extended width portion 411 extends from a front side to a rear side thereof. Locked portions (not shown), which are configured to be detachably locked by the locking portions 312*b* of the toy track 3, are formed on a rear end face of the toy track 4 in which the entrance 41*a* is provided. In addition, locking portions (not shown), which are configured to detachably lock on locked portions 511*b* of the toy track 5, are formed on a front end face of the toy track 4 in which an exit 41*b* is provided.

Figure 4:
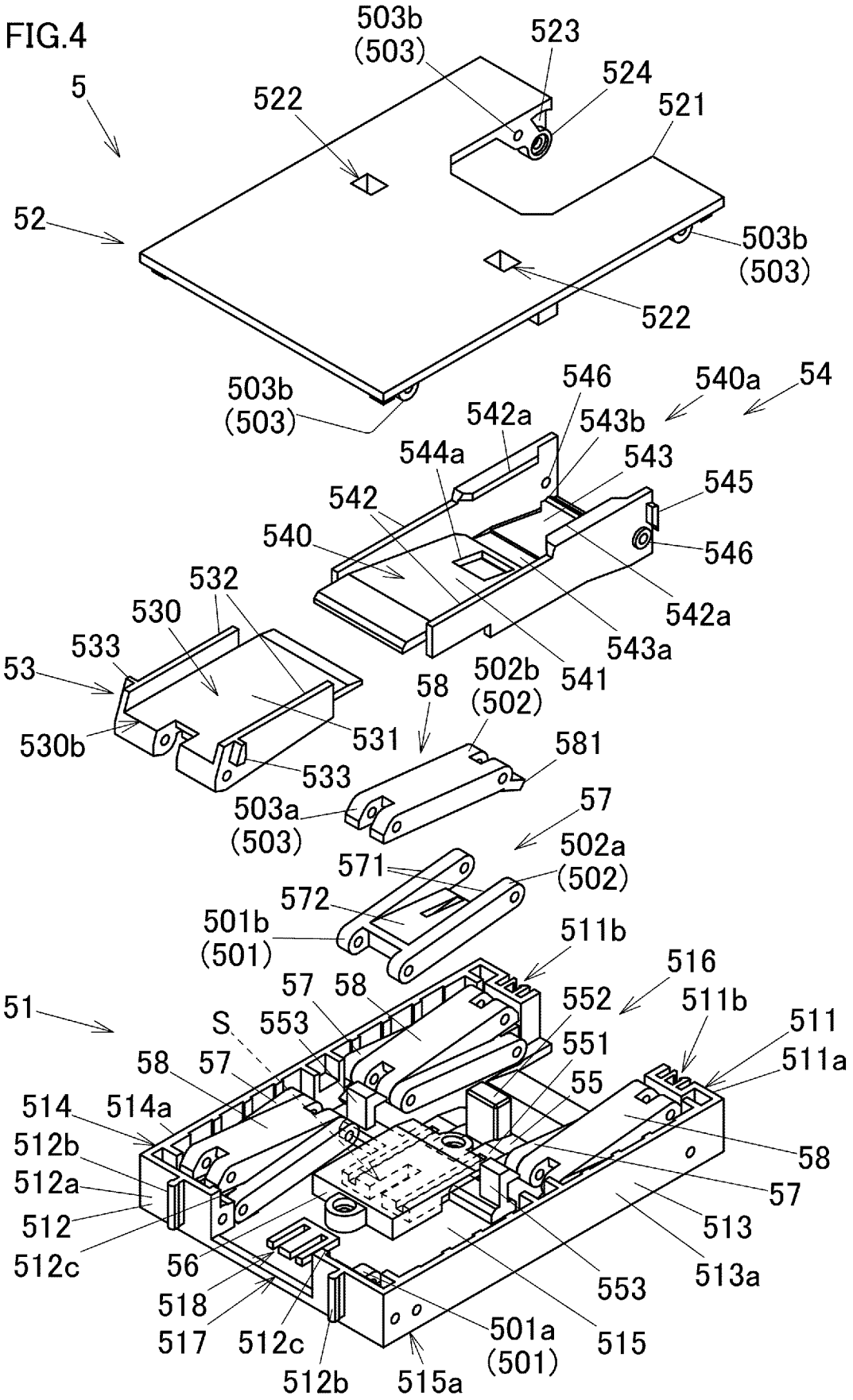
FIG. 4 is an exploded perspective view of the toy track, which is shown in FIG. 2B, according to the embodiment of the present invention.

Next, the configuration of the toy track 5 will be described by reference mainly to FIGS. 1, 2B and 4. As shown in FIG. 1, the toy track 5 includes a base member 51, which is disposed downwards and which has a substantially rectangular flat plate-like shape, and a lid member 52, which is connected to the base member 51 in such a manner as to be allowed to move upwards and downwards by lower support bodies 57 and upper support bodies 58, whereby the toy track 5 is formed into a substantially rectangular flat plate-like shape as a whole when the lid member 52 rests in a closed state. In addition, as shown in FIG. 4, the toy track 5 includes track members 53, 54, which are long in the front-rear direction in an interior of the toy track 5, and a locking member 55 configured to support or hold the lid member 52 in the closed state. With the lid member 52 staying in the closed state, the track members 53, 54 are folded up in a stowed state between the base member 51 and the lid member 52.

The base member 51 has a rear wall 511, a front wall 512, a left wall 513, and a right wall 514 which are formed around an outer circumference of a bottom plate 515, which has a rectangular plate-like shape. The rear wall 511 and the front wall 512 are formed in such a manner as to extend transversely at a rear end and a front end of the bottom plate 515, respectively. The left wall 513 and the right wall 514 are formed in such a manner as to extend in the front-rear direction along a left longitudinal edge and a right longitudinal edge of the bottom plate 515, respectively. In addition, the base member 51 has a rear end face 511*a*, a front end face 512*a*, a left side surface 513*a*, a right side surface 514*a*, and a bottom surface 515*a*, which each have a flat outer surface.

A shaft portion 501*a*, to which the lower support body 57 is connected rotatably, is formed at a front and a rear of an inner surface of each of the left wall 513 and the right wall 514 (that is, at four corners of the base member 51) (only one shaft portion 501*a* is shown in FIG. 4). An entrance opening portion 516, which is continuously cut out into a rectangular shape, is formed in a transversely central portion of the rear wall 511 and a transversely central portion of a rear end of the bottom plate 515. The entrance opening portion 516 is formed in a side of the track member 54 where an entrance 540*a* is provided. In addition, an exit opening portion 517 is formed in a transversely central portion of the front wall 512. The exit opening portion 517 is cut out in substantially the same width as that of the entrance opening portion 516. The exit opening portion 517 is formed in a side of the track member 53 where an exit 530*b* is provided.

Figure 2B:
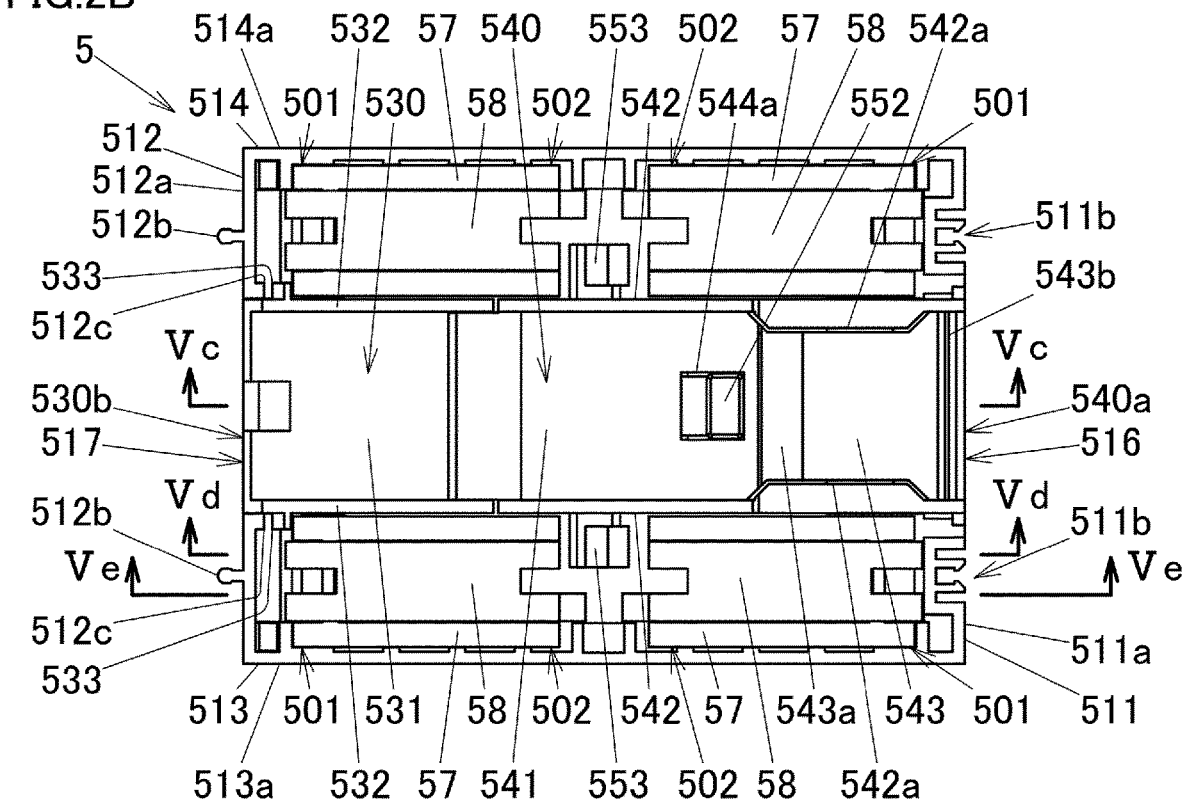
FIG. 2B is a plan view of a transformable toy track according to the embodiment of the present invention with a lid member omitted from illustration, which constitutes a rear-stage toy track shown in FIG. 1.

As shown in FIGS. 2B and 4, a locked portion 511*b* (a second locked portion), which has a similar shape to that of the locked portion 311*b* of the toy track 3, is formed on the rear end face 511*a* of the rear wall 511 in a similar position to that where the locked portion 311*b* is formed. Additionally, a locking portion 512*b* (a second locking portion), which has a similar shape to that of the locking portion 312*b* of the toy track 3, is formed on the front end face 512*a* of the front wall 512 in a similar position to that where the locking portion 312*b* is formed.

In FIG. 4, the locking member 55 and a guide member 56 for guiding the locking member 55 in sliding are disposed substantially at a center of the bottom plate 515. A receiving portion 518 is formed on the bottom plate 515 at a front side of the guide member 56, and this receiving portion 518 supports a biasing member (not shown) such as a torsion coil spring for biasing the track member 53 in a rising direction.

The locking member 55 is formed movably in the front-rear direction inside the guide member 56. The locking member 55 has a flat plate-shaped base portion 551 disposed substantially parallel to the bottom plate 515, a quadrangular prism-shaped releasing projection 552 provided in such a manner as to rise upwards from a rear end of the base portion 551 which faces the entrance opening portion 516, and a plurality of locking portions 553 (a first locking portion) provided in such a manner as to rise upwards from a position of the base portion 551 which lies nearer to the exit opening portion 517 than the releasing projection 552 does. A claw portion extending to the rear is formed on a rear side (a side facing the releasing projection 552) of a distal end portion of each of the locking portions 553.

The guide member 56 is formed into a substantially flat plate-like shape. The guide member 56 restricts a movable range of the locking member 55 when the locking member 55 moves forwards and rearwards by covering partially the base portion 551 of the locking member 55 from above. Then, as shown in FIG. 5C, the locking member 55 is biased to the rear of the guide member 56 by a biasing member (not shown) such as a compression coil spring provided within a space S defined inside the guide member 56.

Figure 5C:
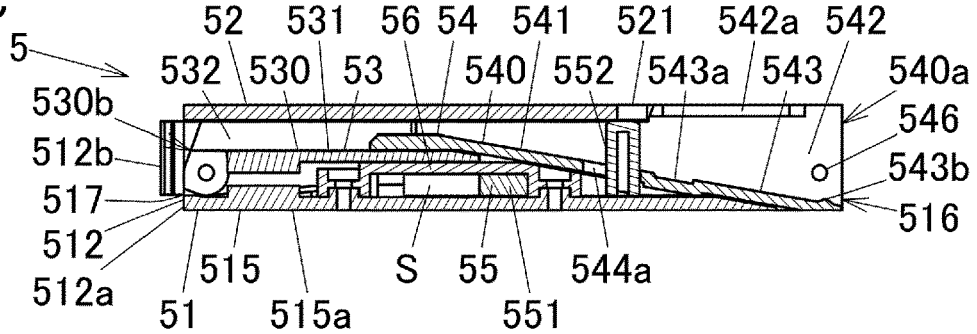
FIGS. 5C, 5D, and 5E are sectional views of the toy track, which is in the stowed state, according to the embodiment of the present invention, which are taken along lines Vc-Vc, Vd-Vd, and Ve-Ve of the toy track shown in FIG. 2B, respectively.

When combined together and stowed in the base member 51, the front track member 53 and the rear track member 54 are formed into a long and flat plate-like shape having substantially the same longitudinal length as that of the base member 51 (also, refer to FIG. 5C). The track member 53 is connected rotatably to a front end side of the base member 51 where the exit opening portion 517 is provided. The track member 53 is biased in a direction in which the track member 53 rises from the base member 51. In addition, the track member 54 is connected rotatably to a rear end side of the lid member 52 where a cut-out portion 521 is formed. The track member 54 is configured to rotate by its own weight. A front end of the rear track member 54 is disposed to be in abutment with an upper surface of a track surface portion 531 of the front track member 53.

The track member 53 has the track surface portion 531 and side walls 532 which extend upwards and downwards from left- and right-hand sides of the track surface portion 531. The side wall 532 is formed in such a manner as to extend from a front end towards a rear end of the track surface portion 531 excluding a rear end portion. A track portion 530, which is a recessed space extending in the front-rear direction, is defined by the track surface portion 531 and the side walls 532. A restricting projection 533 is formed on an outer surface of each of the left and right side walls 532 in a position lying close to the exit 530*b*. With the track member 53 in a deployed state, the restricting projections 533 are brought into abutment with an inner surface 512*c* of the front wall 512 of the base member 51 so as to restrict a rotation of the track member 53 in a rising direction.

The track member 54 has a track surface portion 541 and side walls 542 which extend upwards and downwards from left- and right-hand sides of the track surface portion 541. The side wall 542 is formed in such a manner as to extend from a rear end towards a front end of the track surface portion 541 excluding a front end portion. A track portion 540, which is a recessed space extending in the front-rear direction, is defined by the track surface portion 541 and the side walls 542. The track portions 530, 540 of the track member 53 and the track member 54 are continuously coupled together in the front-rear direction so as to constitute a substantially straight track portion on which the toy vehicle can 2 travel.

A waiting portion 543 for the toy vehicle 2 is formed on the track surface portion 541 at a side thereof where an entrance 540*a* is provided. In a state in which the track member 54 is stowed, the waiting portion 543 is formed in such a manner as to slope downwards as it extends rearwards in a position lying lower in level than a front side (including the side of the track surface portion 531 of the track member 53 where the exit 530*b* is provided) of the track surface portion 541 (refer to FIG. 5*c*). A depressed portion 543*a* is formed ahead of the waiting portion 543 so as to restrict forward and rearward movements of the toy vehicle 2 by allowing the front wheels 21 of the toy vehicle 2 to loosely be fitted therein. In addition, a restricting projection 543*b* is formed at the rear of the waiting portion 543 so as to restrict a rearward movement of the toy vehicle 2 by holding the rear wheels 22 of the toy vehicle 2. The depressed portion 543*a* and the restricting projection 543*b* are formed in such a manner as to extend transversely of the waiting portion 543 to function as a vehicle stopper.

An opening portion 544*a* is formed in the track surface portion 541 ahead of the waiting portion 543. With the track member 54 held in the stowed state, as shown in a sectional view of FIG. 5C, the releasing projection 552 of the locking member 55 is inserted and passed through the opening portion 544*a*. Consequently, a distal end portion of the releasing projection 552 is positioned above the track surface portion 541. On the other hand, with the track member 54 held in the stowed state, the distal end portions of the locking portions 553 of the locking member 55 are positioned above the track surface portion 541 and are locked on the locked portions 522 (the first locked portion) of the lid member 52 which is folded up into the closed state to thereby hold the lid member 52 in the closed state.

As with the track member 33 of the toy track 3, support projections 542*a* are provided on facing inner surfaces of the side walls 542 of the waiting portion 543 in such a manner as to project therefrom so as to prevent the toy vehicle 2 stopping at the waiting portion 543 from derailing. Restricting projections 545 are formed on outer surfaces of the left and right side walls 542 at portions close to the entrance 540*a*. With the track member 54 held in a deployed state, the restricting projections 545 are brought into abutment with inner edges of groove portions 523 of the lid member 52, which will be described later, to thereby restrict a downward rotation of the track member 54.

The lower support body 57 is formed substantially into a rectangular shape, as a whole, which is long in the front-rear direction. The lower support body 57 has support rod portions 571 which are disposed at left- and right-hand sides and a plate portion 572 which is connected to the support rod portions 571 in such a manner as to slope down between the support rod portions 571. Shaft portions 501*b*, 502*a* are formed at a front end and a rear end of the support rod portion 571 in a longitudinal direction thereof. One shaft portion 501*b* of the support rod portion 571 is connected rotatably to the shaft portion 501*a* of the base member 51, and the other shaft portion 502*a* is connected rotatably to a shaft portion 502*b* of the upper support body 58, which will be described later.

The upper support body 58 is formed into a rectangular shape which is long in the front-rear direction and has a transverse width which is narrower than a space defined between the support rod portions 571 of the lower support body 57. The upper support body 58 is disposed above the lower support body 57 and can be disposed partially between the support rod portions 571 when the toy track 5 rests in the stowed state (refer to three upper support bodies 58 which are disposed inside the base member 51 shown in FIG. 4). Shaft portions 503*a*, 502*b* are formed at a front end and a rear end of the upper support body 58 in a longitudinal direction thereof. The shaft portions 502*b* of the upper support body 58 are connected with the shaft portions 502*a* of the lower support body 57, while the shaft portions 503*a* of the upper support body 58 are connected rotatably with shaft portions 503*b* of the lid member 52. In addition, a restricting projection 581 is formed in such a manner as to project from a side of the upper support body 58 where the shaft portion 502*b* is provided so as to be brought into abutment with the plate portion 572 to thereby restrict a rotation angle of the upper support body 58 relative to the lower support body 57.

In this embodiment, the left and right lower support bodies 57 which are disposed at the front of the base member 51 constitute a hinge portion 501 at a front end portion and are connected rotatably to the base member 51, while the left and right lower support bodies 57 which are disposed at the rear of the base member 51 constitute a hinge portion 501 at a rear end portion and are connected rotatably to the base member 51. In addition, the left and right upper support bodies 58 which are disposed at the front of the base member 51 constitute a hinge portion 502 at a rear end portion and are connected rotatably to the corresponding lower support bodies 57, while the left and right upper support bodies 58 which are disposed at the rear of the base member 51 constitute a hinge portion 502 at a front end portion and are connected rotatably to the corresponding lower support bodies 57. In addition, the left and right upper support bodies 58 which are disposed at the front of the base member 51 constitute a hinge portion 503 at a front end portion and are connected rotatably to the lid member 52, while the left and right upper support bodies 58 which are disposed at the rear of the base member 51 constitute a hinge portion 503 at a rear end portion and are connected rotatably to the lid member 52.

Figure 5D:
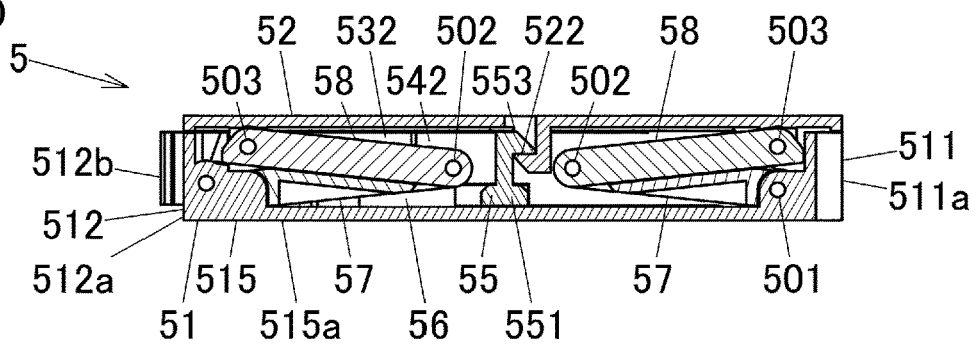
Figure 5E:
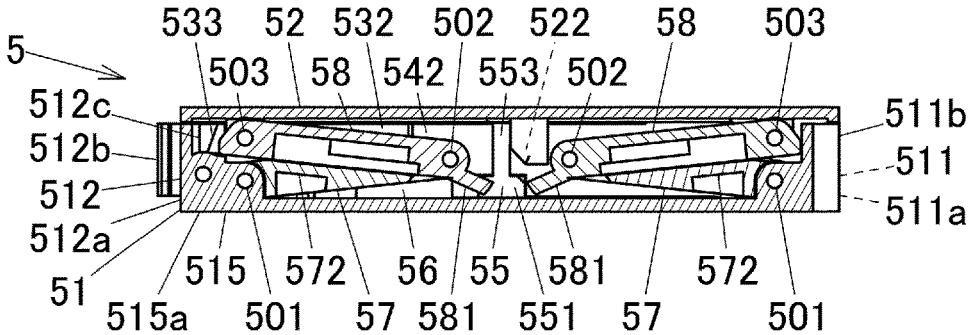

The lid member 52 is formed into a laterally symmetrical flat plate-like shape. The lid member 52 has shaft portions 503*b* which make up the hinge portion 503 together with the shaft portions 503*a* of the upper support body 58. The lid member 52 can be raised upwards away from and lowered downwards towards the base member 51 by the lower support bodies 57 and the upper support bodies 58. The lid member 52 has the cut-out portion 521, which is cut out substantially into a rectangular shape, at a rear end portion thereof which corresponds to the portion of the track member 54 where the entrance 540*a* is provided. Locked portions 522 (a first locked portion) are formed ahead of the cut-out portion 521 of the lid member 52. As shown in FIG. 5D, the locked portion 522 has a claw portion formed on a rear surface of the lid member 52 in such a manner as to extend to the front so as to be locked on the claw portion of the locking portion 553.

In addition, the groove portion 523 is formed at an inner edge portion at a rear end portion of the cut-out portion 521. A shaft portion 524 is formed in a position lying below the groove portion 23 so as to make up the hinge portion together with a shaft portion 546 provided at a rear end portion of the track member 54. The groove portion 523 is provided at a part along a full outer circumference of the shaft portion 524 and can accommodate the restricting projection 545 of the track member 54 in such a manner as to slide therein. With the track member 54 resting in the deployed state, the restricting projection 545 is brought into abutment with inner edge of the front end portion of the groove portion 523 so as to restrict a downward rotation of the track member 54.

Next, operations of the toy tracks 3, 5 occurring when the toy vehicle 2 travels thereinto will be described. In the toy track 3 shown in FIG. 5A, when the toy vehicle 2 shown in FIG. 1 enters the toy track 3 from the side where the entrance 330*a* is provided, the releasing projection 342 is pressed by the recessed portion 241 defined between the front ribs 24 of the toy vehicle 2. The front wheels 21 of the toy vehicle 2 are loosely fitted in the depressed portion 333*a*, and the rear wheels 22 of the toy vehicle 2 are positioned ahead of the restricting projection 333*b*. As a result, the toy vehicle 2 is restricted from moving forwards and rearwards. Since the releasing projection 342 is pressed as described above, the locking member 34 advances against the biasing force of the biasing member, whereby the locking of the locking portions 343 on the locked portions 322 (refer to FIG. 5B) is released. The lid members 32A, 32B, which are held in the closed state by the locking portions 343, are deployed in an opening direction around the hinge portion 301 (refer to the toy track 3 shown in FIGS. 6 and 8).

Figure 6:
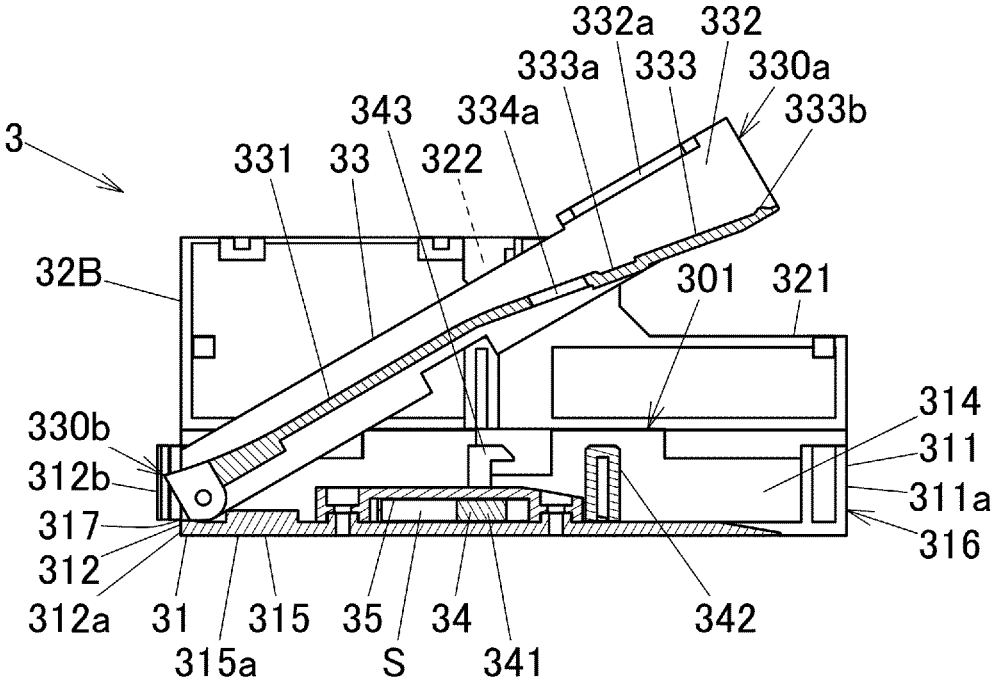
FIG. 6 is a sectional view of the toy track according to the embodiment of the present invention shown in FIG. 5A, which is in a deployed state.

Then, the track member 33, which is held in the stowed state by the lid member 32, rotates upwards by means of the resilient force, whereby the track surface portion 331 of the track member 33 including the waiting portion 333 slopes down to the front (refer to FIG. 6). The rotation of the track member 33 is restricted to the predetermined angle as a result of the restricting projections 335 of the track member 33 being brought into abutment with the inner surface 312*c* of the front wall 312. When the track surface portion 331 slopes down to the front, allowing the front wheels 21 of the toy vehicle 2 to leave the depressed portion 333*a*, the toy vehicle 2 can run smoothly on the track surface portion 331 towards the exit 330*b*. Then, the toy vehicle 2, which has left the toy track 3 byway of the exit 330*b*, can now enter the toy track 4, which is coupled to the toy track 3 as the next-stage toy track, from the side where the entrance 41*a* is provided, whereby the toy vehicle 2 can run on the track portion 41.

The toy vehicle 2, which has entered the toy track 4, is easily guided along the track portion 41 to the side thereof where the exit 41*b* is provided by the extended width portion 411. Thus, the toy vehicle 2 maintains its momentum gained when the toy vehicle 2 is caused to run out from the toy track 3 and keeps running from the exit 41*b* of the track portion 41 into the next-stage toy track 5.

Figure 7A:
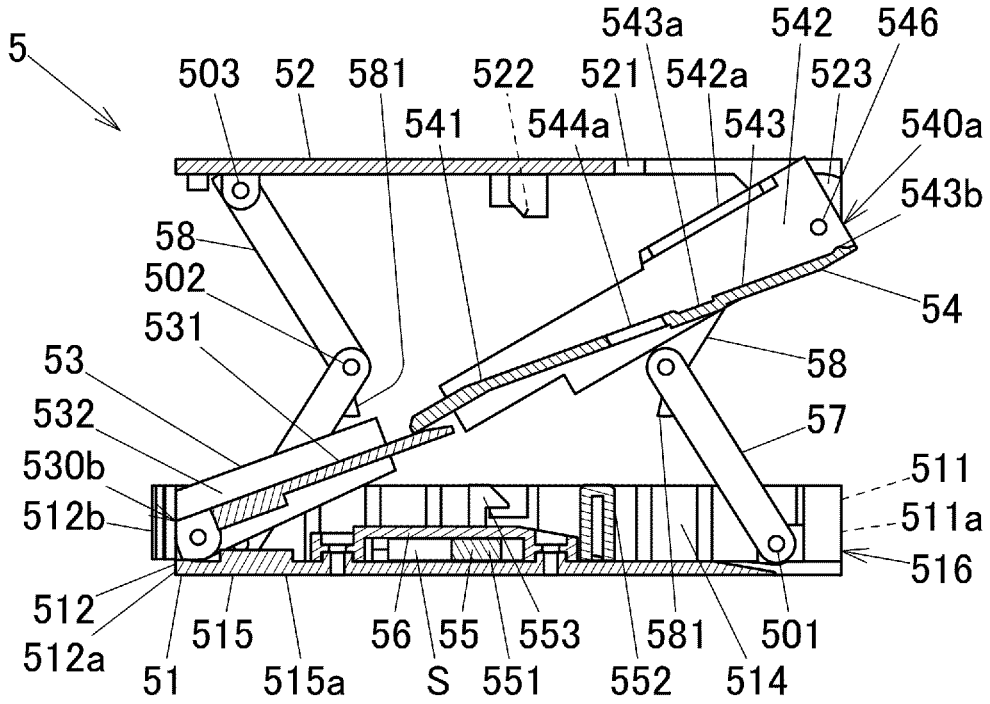
FIG. 7A is a sectional view of the toy track, which is in the deployed state, according to the embodiment of the present invention, which corresponds to the sectional view taken along the line Vc-Vc in FIG. 2B.
Figure 7B:
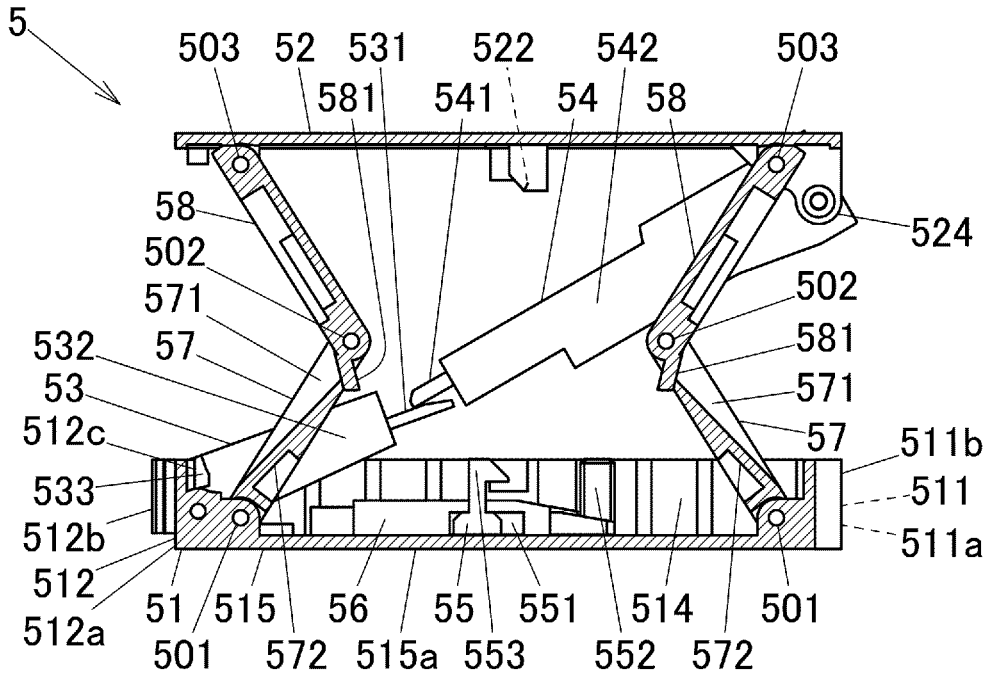
FIG. 7B is a sectional view of the toy track, which is in the deployed state, according to the embodiment of the present invention, which corresponds to the sectional view taken along the line Ve-Ve in FIG. 2B.

In the toy track 5, when the toy vehicle 2 enters the side where the entrance 540*a* is provided, the releasing projection 552 is pressed by the recessed portion 241 of the toy vehicle 2. The front wheels 21 of the toy vehicle 2 are loosely fitted in the depressed portion 543*a*, and the rear wheels 22 of the toy vehicle 2 are positioned ahead of the restricting projections 543*b*. As a result, the toy vehicle 2 is restricted from moving forwards and rearwards. In addition, since the releasing projection 552 is pressed as described above, the locking member 55 advances against the biasing force of the biasing member, whereby the locking of the locking portions 553 on the locked portions 522 (refer to FIG. 5D) is released. The lid member 52, which is held in the closed state by the locking portions 553, is raised by means of the biasing force with which the lower support bodies 57 and the upper support bodies 58 are extended upwards. The rotation angle of the upper support body 58 relative to the lower support body 57 is restricted by the restricting projections 581 being brought into abutment with the plate portion 572 (FIG. 7B). Consequently, the extending movement of the lower support bodies 57 and the upper support bodies 58 is stopped, whereby the lid member 52 stops rising in a predetermined height position.

The track member 53, which is held in the stowed state by the lid member 52, rotates upwards by means of the resilient force, and the track member 54 rotates downwards. As a result, whereby the track surface portion 541 of the track member 54 including the waiting portion 543 slopes down to the front (refer to FIGS. 7A and 8). The rotation of the track member 54 is restricted as a result of the restricting projections 533 of the track member 53 being brought into abutment with the inner surface 512*c* of the front wall 512. When the track surface portion 531 slopes down to the front, allowing the front wheels 21 of the toy vehicle 2 to leave the depressed portion 543*a*, the toy vehicle 2 can run smoothly on the track surface portion 531 towards the exit 530*b*. Then, the toy vehicle 2, which has left the toy track 5 by way of the exit 530*b*, can run towards a toy track coupled to the toy track 5 as the next-stage toy track.

The toy tracks 3, 5 can cause the toy vehicle 2 to move vigorously in the same traveling direction as the traveling direction in which the toy vehicle 2 enters the toy tracks 3, 5. In addition, since the toy tracks 3, 5 are deployed from the stowed state, the player can enjoy the transforming actions thereof that occur as the toy vehicle 2 travels ahead.

Figure 9:
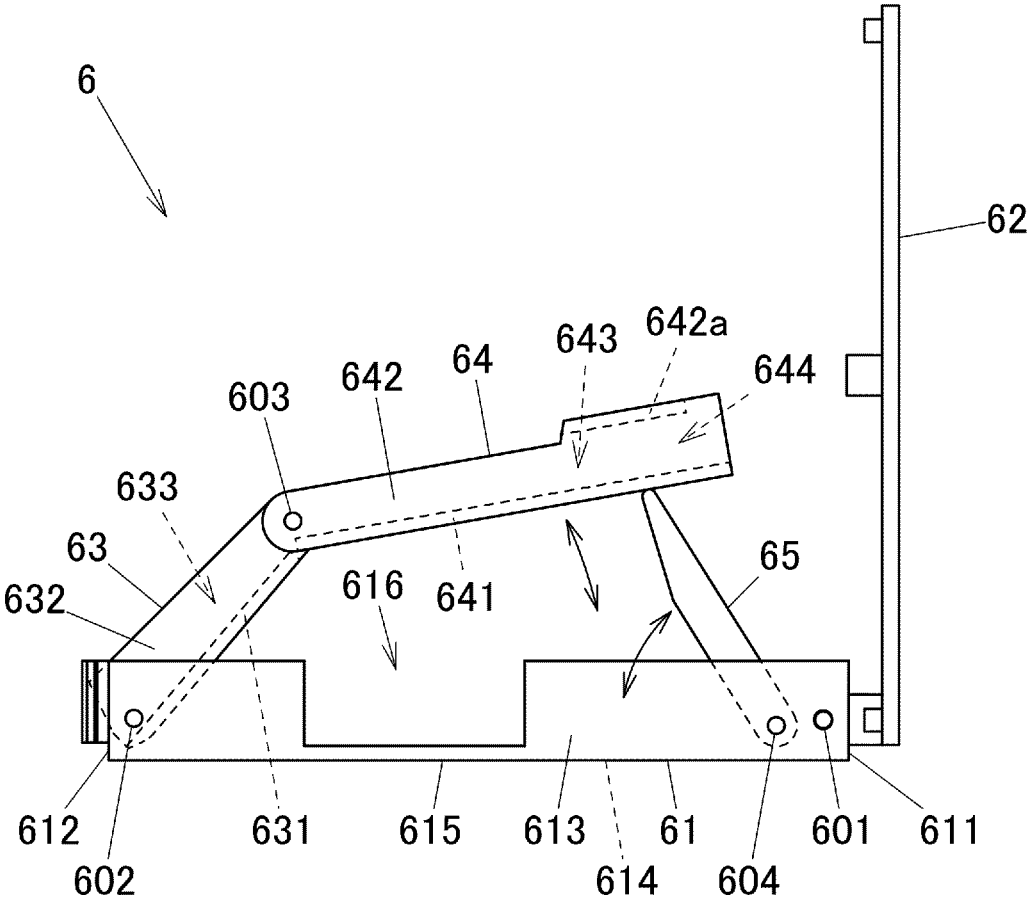
FIG. 9 is a side view of another example of a toy track according to the embodiment of the present invention, which is denoted as Example 1.

Next, in addition to the toy tracks described heretofore, another example of a toy track according to the embodiment of the present invention will be described as Example 1. FIG. 9 shows schematically a left side view of a toy track 6, which is in a deployed state. As with the toy tracks 3, 5, the toy track 6 includes a base member 61, which is disposed downwards and which has a substantially rectangular flat plate-like shape, and a lid member 62, which is connected to the base member 61 rotatably around a hinge portion 601, whereby the toy track 6 is formed into a substantially rectangular flat plate-like shape as a whole when the lid member 62 rests in a closed state. As with the toy tracks 3, 5, the base member 61 has a rear wall 611, a front wall 612, a left wall 613, and a right wall 614 which are formed around an outer circumference of a bottom plate 615, which has a rectangular plate-like shape. The hinge portion 601 is provided at a rear end portion of the base member 61, whereby the lid member 62 can be opened and closed in a front-rear direction. In describing the toy track 6 below, a right-hand side of FIG. 9 is referred to as the rear of the toy track 6, and an opposite side is referred to as the front thereof. In addition, an upper side of FIG. 9 is referred to as the up of the toy track 6, and an opposite side is referred to as the down thereof. Further, when looking at FIG. 9 in a depth direction, a farther side is referred to as the right of the toy track 6, and a near side is referred to as the left thereof.

The toy track 6 has a front track member 63 and a rear track member 64 which are disposed along the front-rear direction of the toy track 6. The track member 63 is biased resiliently in a rising direction by a hinge portion 602 provided at a front end portion of the base member 61. As with the toy tracks 3, 5, the track member 63 has a track surface portion 631 and side walls 632 which are provided along left and right side edges of the track surface portion 631, whereby the track member 63 has a track portion 633 which extends in the front-rear direction and which constitutes a recessed space when seen from the rear.

The track member 64 is connected rotatably to a rear end side of the track member 63 by a hinge portion 603. The track member 64 also has a track surface portion 641 and side walls 642 which are provided along left and right side edges of the track surface portion 641, whereby the track member 64 has a track portion 643 which extends in the front-rear direction. In addition, as with the toy tracks 3, 5, a waiting portion 644 including a depressed portion and a restricting projection can be provided at a rear portion of the track portion 643. Additionally, support projections 642*a*, which are similar to the support projections 332*a*, 542*a*, are provided on facing inner surfaces of the track portion 643 in such a manner as to project therefrom at an entrance side of the track portion 643.

A pillar-shaped or plate-shaped support body 65 is formed at a rear side of the base member 61. The support body 65 is also elastically biased in a rising direction and is connected rotatably to the base member 61 by a hinge portion 604. When the lid member 62 is deployed in an opening direction, the track member 64 is lifted upwards by the front track member 63 and is supported from below by the support body 65 provided at the rear side of the base member 61 when the support body 65 rises. When the track member 64 is deployed, the track surface portion 641 of the track member 64 stops still at an angle at which the track surface portion 641 slopes slightly down to the front.

The base member 61 includes further a track portion 616 through which the toy vehicle 2 can pass in a left-right direction. When the toy track 6 is deployed, this track portion 616 is defined below the track members 63, 64 and the support body 65 which are deployed substantially into a trapezoidal frame-like configuration in the side view of FIG. 9. In addition, by providing a locking portion or a locked portion, not shown, on the left side wall 613 and the right side wall 614 of the base member 61, the base member 61 can enable the toy track 6 to be coupled to other toy tracks in the left-right direction. Consequently, the toy track 6 can be formed into a two-level crossing card-like configuration.

According to the toy track 6, the player can enjoy playing with the track portions 633, 643, 616 which are configured into the two-level crossing structure which appears as a result of the transformation of the toy track 6, whereby the player can enjoy fabricating various traveling courses by combining the plurality of toy tracks.

Figure 10:
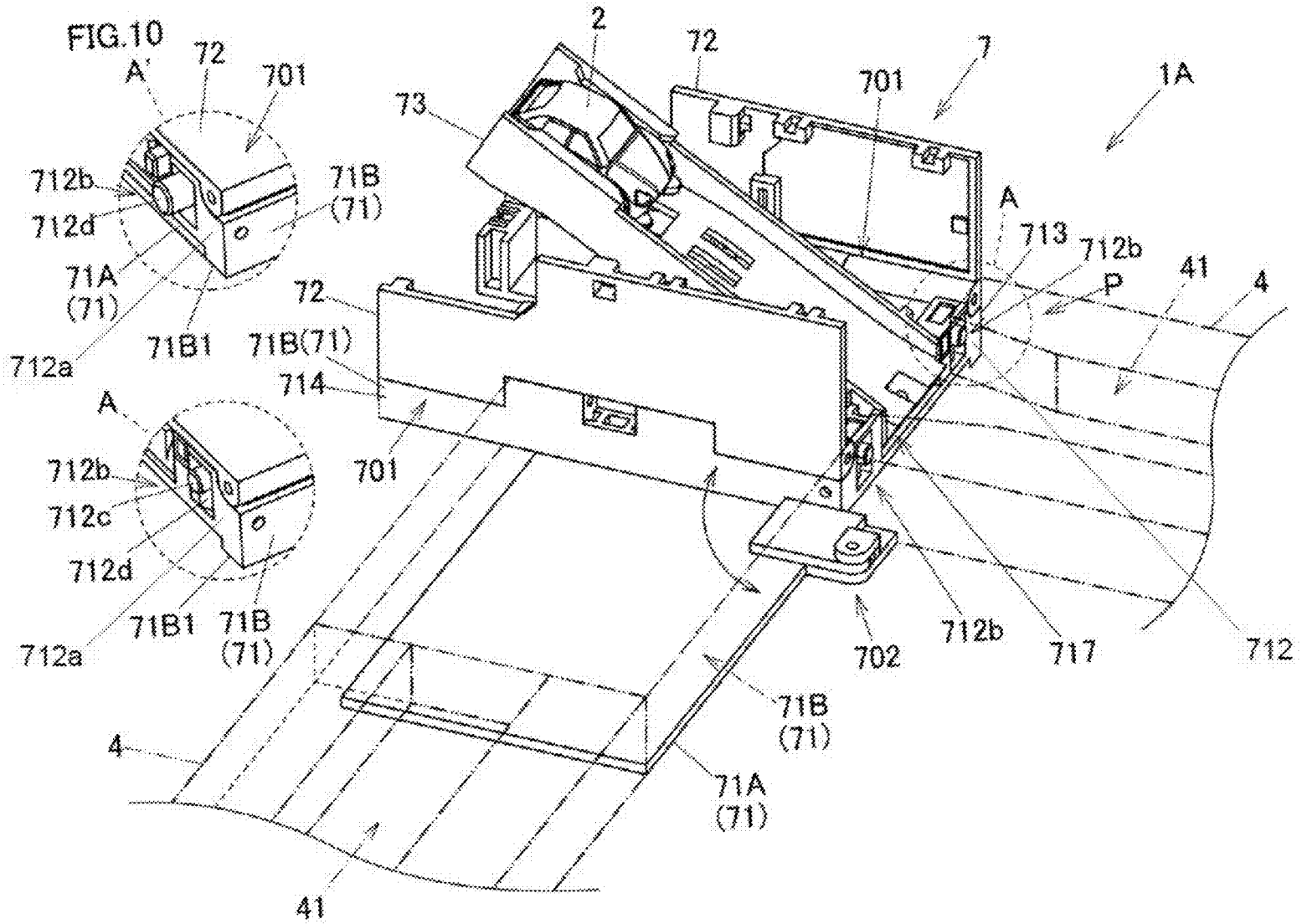
FIG. 10 is a perspective view of a toy track set including a further example of a toy track according to the embodiment of the present invention, which is denoted as Example 2.

FIG. 10 is a perspective view of a toy track set 1A including a toy track 7 in a deployed state, which constitutes a further example of a toy track according to the embodiment of the present invention. As with the toy tracks 3, 5, the toy track 7 includes a base member 71, which is disposed downwards and which has a substantially rectangular flat plate-like shape, and a lid member 72, which is connected to the base member 71 rotatably around a hinge portion 701, whereby the toy track 7 is formed into a substantially rectangular flat plate-like shape as a whole when the lid member 72 rests in a closed state. In the toy track 7, the lid member 72 and a track member 73 can be configured so as to operate in a similar manner to that in which the lid member 32 and the track member 33 of the toy track 3 operate when the toy vehicle 2 enters it. In the toy track 7, the base member 71 can be caused to rotate through 90 degrees when the toy vehicle 2 enters the toy track 7.

Specifically speaking, the base member 71 has a fixed portion 71A which is disposed on a resting surface side of the toy track 7 and a movable portion 71B which is disposed above the fixed portion 71A. The lid member 72 and the track member 73 are formed on the movable portion 71B. The fixed portion 71A is disposed between a front-stage toy track 4 from which the toy vehicle 2 enters the toy track 7 and a rear-stage toy track 4 from which the toy vehicle 2 runs out. The two toy tracks 4 shown in FIG. 10 are disposed in such a manner that track portions 41 are substantially at right angles to each other. The fixed portion 71A can be positioned so as to be connected to the toy tracks 4.

A locking portion 712*b* (a second locking portion), which is configured to be locked on a locked portion of another toy track, is formed on a front surface 712*a* of a front wall 712 of the fixed portion 71A at each of sides of an exit opening portion 717 where a left side wall 713 and a right side wall 714 are provided. As shown in an enlarged view of a portion A as seen from a direction P, the locking portion 712*b* has a locking projection 712*c* and a locking projection 712*d* which project in two directions substantially into an L-shape. The locking portion 712*b* can be rotated around a transverse shaft so as to switch the locking projection which is caused to project towards the front wall 712 to the locking projection 712*c* (the enlarged view of the portion A) or the locking projection 712*d* (an enlarged view of a portion A'). Both the locking projections 712*c*, 712*d* are formed into a short cylindrical shape. The locking projection 712*c* is formed smaller in outside diameter and lower in height than the locking projection 712*d*. Locked portions of another toy track, which are configured to be locked by the locking projections 712*c*, 712*d*, can be formed into groove-like shapes which follow external shapes of the locking projections 712*c*, 712*d* (for example, circular hole-like shapes having slightly greater outside diameters than those of the corresponding locking projections).

In the case that the locking projection 712*c* is caused to project towards the front wall 712, the movable portion 71B is caused to rotate substantially through 90 degrees as a result of the toy vehicle 2 entering the toy track 7, whereby the toy track 7 can be used as a curve card in which the exit direction of the toy vehicle 2 can be changed. On the other hand, in the case that the locking projection 712*d* is caused to project towards the front wall 712, the movable portion 71B is not caused to rotate even though the toy vehicle 2 enters the toy track 7, and as with the toy track 3 shown in FIG. 1, the lid member 72 and the track member 73 are deployed, so that the toy vehicle 2 can be caused to run out of the toy track 7 in the same direction as the direction in which the toy vehicle 2 enters the toy track 7.

In the case that the toy track 7 is used as the curve card, the toy track 7 operates as will be described below. As with the toy track 3 shown in FIG. 1, in an initial state in which the lid member 72 is in the closed state, the movable portion 71B is disposed in the position above the fixed portion 71A (a position indicated by alternate long and short dash lines). Projecting portions 71B1, which are formed on portions of a lower surface of the movable portion 71B, are brought into abutment with the resting surface of the toy track 7, as with the fixed portion 71A, so as to support stably the whole of the toy track 7.

When the toy vehicle 2 enters from the front-stage toy track 4 and presses against a releasing projection (corresponding to the releasing projection 342 of the toy track 3), not shown, the movable portion 71B rotates around a hinge portion 702 relative to the fixed portion 71A. The movable portion 71B rotates substantially through 90 degrees to thereby connect to the next-stage toy track 4. At this time, since the locking projection 712*c*, which is smaller in outside diameter and lower in height than the locking projection 712*d*, is formed on the front wall 712, the locking projection 712*c* can easily be locked on the locked portion of the toy track 4 to which the movable portion 71B connects. Thereafter, as with the toy track 3 shown in FIG. 1, in the toy track 7, the lid member 72 and the track member 73 can be deployed, whereby the toy vehicle 2 can run out from the toy track 7.

With the toy track 7, the toy vehicle 2 can be caused to run out in a different direction from the direction in which the toy vehicle 2 enters the toy track 7 by transforming the track member 73 in such a manner as to slope down to the front. In this way, the toy vehicle 2 can move in the different direction by changing its traveling direction without losing its momentum.

Thus, while the embodiment of the present invention has been described heretofore, the present invention is not limited to the embodiment and hence can be carried out by modifying the embodiment variously. For example, the rotation angle of the toy track 7 shown in FIG. 10 is not limited to substantially the 90 degrees, and hence, the toy track 7 can be used as a curve card that can rotate through substantially 180 degrees.

The toy tracks 3, 5 to 7 may include a movable portion that is deployed as a result of entrance of the toy vehicle 2 in addition to the lid members and the track members. For example, the movable portion can be formed by body portions of an animal or human-shaped robot such as a torso, arms, legs and a head or the like, so that the robot rises when it is deployed. After the robot rises, the toy track may cause the toy vehicle 2 to run out from a part (for example, between both the legs) of the robot, causing the toy vehicle 2 to enter the track portion of the next-stage toy track. Alternatively, the toy vehicle 2 may be integrated with the robot into a goal robot which constitutes a goal for the toy vehicle 2.

The releasing projections 342, 552 shown in FIGS. 5B and 5D may be provided with a claw portion at the distal end portion thereof, so that the releasing projections 342, 552 can double as the locking portions 343, 553.

The invention claimed is:

1. A toy track, comprising:

a base member;

a track member having a track surface portion on which a running body can travel and biased so as to be put in a deployed state in which the track surface portion slopes down to a front relative to the base member;

a lid member connected to the base member in such a manner as to be opened and closed and having a first locked portion; and a locking member having a base portion, a releasing projection provided at an entrance side of the base portion disposed on the track surface portion of the track member in a stowed state and a first locking portion provided at an exit side of the base portion configured to be locked on the first locked portion to hold the lid member in a closed state, wherein the locking member is provided on the base member while being biased towards the entrance side, wherein the lid member biases the track member into the stowed state when in the closed state, and wherein the locking member releases locking of the first locking portion on the first locked portion when the releasing projection is pressed towards the exit side by the running body that enters the track surface portion.

2. The toy track according to claim 1, wherein the running body is a toy vehicle having a wheel.

3. The toy track according to claim 2, wherein a waiting portion where the toy vehicle is caused to wait is formed on the track surface portion on an entrance side of the releasing projection disposed on the track surface portion, and wherein when the track surface portion slopes down to the front, the wheel of the toy vehicle leaves the waiting portion, and the toy vehicle is allowed to run towards an exit side of the track surface portion.

4. The toy track according to claim 3, wherein the track member has side walls which rise from both left- and right-hand sides of the track surface portion, and wherein support projections are provided on facing inner surfaces of the side walls at the waiting portion in such a manner as to project therefrom to thereby prevent the toy vehicle from leaving the track surface portion.

5. The toy track according to claim 3, wherein the waiting portion has a depressed portion in which a front wheel of the toy vehicle is fitted loosely and slopes down to a rear when the track member rests in the stowed state.

6. The toy track according to claim 4, wherein the waiting portion has a depressed portion in which a front wheel of the toy vehicle is fitted loosely and slopes down to a rear when the track member rests in the stowed state.

7. The toy track according to claim 1, wherein the base member has a rear end face, a front end face, a left side surface, a right side surface, and a bottom surface, which each have a flat outer surface, wherein the lid member has a flat outer surface when the lid member is in the closed state, and wherein the toy track is formed into a rectangular flat plate-like shape as a whole when the lid member is in the closed state.

8. The toy track according to claim 2, wherein the base member has a rear end face, a front end face, a left side surface, a right side surface, and a bottom surface, which each have a flat outer surface, wherein the lid member has a flat outer surface when the lid member is in the closed state, and wherein the toy track is formed into a rectangular flat plate-like shape as a whole when the lid member is in the closed state.

9. The toy track according to claim 3, wherein the base member has a rear end face, a front end face, a left side surface, a right side surface, and a bottom surface, which each have a flat outer surface, wherein the lid member has a flat outer surface when the lid member is in the closed state, and wherein the toy track is formed into a rectangular flat plate-like shape as a whole when the lid member is in the closed state.

10. The toy track according to claim 4, wherein the base member has a rear end face, a front end face, a left side surface, a right side surface, and a bottom surface, which each have a flat outer surface, wherein the lid member has a flat outer surface when the lid member is in the closed state, and wherein the toy track is formed into a rectangular flat plate-like shape as a whole when the lid member is in the closed state.

11. The toy track according to claim 5, wherein the base member has a rear end face, a front end face, a left side surface, a right side surface, and a bottom surface, which each have a flat outer surface, wherein the lid member has a flat outer surface when the lid member is in the closed state, and wherein the toy track is formed into a rectangular flat plate-like shape as a whole when the lid member is in the closed state.

12. The toy track according to claim 6, wherein the base member has a rear end face, a front end face, a left side surface, a right side surface, and a bottom surface, which each have a flat outer surface, wherein the lid member has a flat outer surface when the lid member is in the closed state, and wherein the toy track is formed into a rectangular flat plate-like shape as a whole when the lid member is in the closed state.

13. The toy track according to claim 7, wherein a second locked portion is formed on the rear end face, and wherein a second locking portion configured to be locked on the second locked portion of another toy track is formed on the front end face.

14. The toy track according to claim 8, wherein a second locked portion is formed on the rear end face, and wherein a second locking portion configured to be locked on the second locked portion of another toy track is formed on the front end face.

15. The toy track according to claim 9, wherein a second locked portion is formed on the rear end face, and wherein a second locking portion configured to be locked on the second locked portion of another toy track is formed on the front end face.

16. The toy track according to claim 10, wherein a second locked portion is formed on the rear end face, and wherein a second locking portion configured to be locked on the second locked portion of another toy track is formed on the front end face.

17. The toy track according to claim 11, wherein a second locked portion is formed on the rear end face, and wherein a second locking portion configured to be locked on the second locked portion of another toy track is formed on the front end face.

18. The toy track according to claim 12, wherein a second locked portion is formed on the rear end face, and wherein a second locking portion configured to be locked on the second locked portion of another toy track is formed on the front end face.

* * * * *